US009666391B2

(12) United States Patent
Levatich et al.

(10) Patent No.: US 9,666,391 B2
(45) Date of Patent: May 30, 2017

(54) RETRACTABLE SNAP DOMES

(71) Applicant: Novasentis, Inc., Burlingame, CA (US)

(72) Inventors: Mark Levatich, State College, PA (US); Brian C. Zellers, Bellefonte, PA (US); Edward Foster, Burnham, PA (US); Madeline Boyer, Philadelphia, PA (US); Brian Thaler, State College, PA (US); Raj Pathak, Mountain Top, PA (US); Richard Ducharme, Alexandria, PA (US)

(73) Assignee: Novasentis, Inc., State College, PA (US)

( * ) Notice: Subject to any disclaimer, the term of this patent is extended or adjusted under 35 U.S.C. 154(b) by 0 days.

(21) Appl. No.: 14/520,101

(22) Filed: Oct. 21, 2014

(65) Prior Publication Data

US 2015/0107976 A1 Apr. 23, 2015

Related U.S. Application Data

(60) Provisional application No. 61/894,324, filed on Oct. 22, 2013.

(51) Int. Cl.
*H01H 13/85* (2006.01)

(52) U.S. Cl.
CPC ..... *H01H 13/85* (2013.01); *H01H 2215/016* (2013.01)

(58) Field of Classification Search
CPC ... H01L 41/083; H01L 41/09; H01L 41/0926; H01L 41/39; H01H 13/85; H01H 2215/016; H01H 2215/02
(Continued)

(56) References Cited

U.S. PATENT DOCUMENTS 4,722,146 A * 2/1988 Kemeny ..... E04B 2/7429 160/135
4,982,866 A * 1/1991 Krawagna ..... A45C 11/00 16/227

(Continued)

FOREIGN PATENT DOCUMENTS

JP 2010283926 A 12/2010
JP 2011172339 A 9/2011

(Continued)

OTHER PUBLICATIONS

Matysek, Marc et al., "Combined Driving and Sensing Circuitry for Dielectric Elastomer Actuators in mobile applications", Electroactive Polymer Actuators and Devices (EAPAD) 2011, Proc. of SPIE vol. 7976, 797612, 11 pages.

(Continued)

*Primary Examiner* — Shawki S Ismail
*Assistant Examiner* — Bryan Gordon
(74) *Attorney, Agent, or Firm* — Hogan Lovells US LLP

(57) ABSTRACT

A retractable snap dome in a keyboard, serving as a force resistor for a key in a conventional manner, includes an additional collapsed state wherein the key can be retracted by an electromechanical polymer (EMP) actuator to a persistent down position. In one embodiment, the EMP actuator is a bimorph EMP actuator that can be actuated to bring the key from down position to up position, ready for conventional keyboard operation, and vice versa. Such operations allow the keyboard to have a desirable decreased thickness relative to conventional keyboards. Thus, a keyboard of the present invention finds application in ultra-slim electronic devices. When provided in a notebook computer wherein the keyboard is folded against a video or graphic display, the keyboard keys may be placed in the retracted down position, thereby preventing the keys from pressing against the video (Continued)

or graphical display with a force that may damage the display.

6 Claims, 5 Drawing Sheets

(58) Field of Classification Search
USPC ..... 310/328, 330, 800
See application file for complete search history.

(56) References Cited

U.S. PATENT DOCUMENTS

| | | | | |
|---|---|---|---|---|
| 5,263,876 | A | 11/1993 | Johnescu et al. | |
| 5,315,204 | A * | 5/1994 | Park | H03K 17/964 200/181 |
| 5,350,966 | A | 9/1994 | Culp | |
| 5,519,278 | A | 5/1996 | Kahn et al. | |
| 6,376,971 | B1 | 4/2002 | Pelrine et al. | |
| 6,423,412 | B1 | 7/2002 | Zhang et al. | |
| 6,605,246 | B2 | 8/2003 | Zhang et al. | |
| 6,703,257 | B2 | 3/2004 | Takeuchi et al. | |
| 6,787,238 | B2 | 9/2004 | Zhang et al. | |
| 6,809,462 | B2 | 10/2004 | Pelrine et al. | |
| 6,877,325 | B1 | 4/2005 | Lawless | |
| 6,888,291 | B2 | 5/2005 | Arbogast et al. | |
| 7,038,357 | B2 | 5/2006 | Goldenberg et al. | |
| 7,301,114 | B2 * | 11/2007 | Sano | H01H 13/7006 200/5 A |
| 7,339,572 | B2 | 3/2008 | Schena | |
| 7,368,862 | B2 | 5/2008 | Pelrine et al. | |
| 7,567,681 | B2 | 7/2009 | Pelrine et al. | |
| 7,944,735 | B2 | 5/2011 | Bertin et al. | |
| 7,952,261 | B2 | 5/2011 | Lipton et al. | |
| 7,971,850 | B2 | 7/2011 | Heim et al. | |
| 8,222,799 | B2 | 7/2012 | Polyakov et al. | |
| 8,362,882 | B2 | 1/2013 | Heubel et al. | |
| 8,384,271 | B2 | 2/2013 | Kwon et al. | |
| 8,390,594 | B2 | 3/2013 | Modarres et al. | |
| 8,427,441 | B2 | 4/2013 | Paleczny et al. | |
| 8,564,181 | B2 | 10/2013 | Choi et al. | |
| 2007/0152974 | A1 | 7/2007 | Kim et al. | |
| 2007/0200466 | A1 * | 8/2007 | Heim | B64C 33/02 310/311 |
| 2007/0200467 | A1 | 8/2007 | Heydt et al. | |
| 2008/0157631 | A1 * | 7/2008 | Heim | F04B 19/006 310/330 |
| 2008/0284277 | A1 | 11/2008 | Kwon et al. | |
| 2009/0002205 | A1 | 1/2009 | Klinghult et al. | |
| 2009/0002328 | A1 | 1/2009 | Ullrich et al. | |
| 2009/0200336 | A1 * | 8/2009 | Koh | B65D 1/32 222/173 |
| 2010/0079264 | A1 | 4/2010 | Hoellwarth | |
| 2010/0090813 | A1 | 4/2010 | Je et al. | |
| 2010/0316242 | A1 | 12/2010 | Cohen et al. | |
| 2011/0038625 | A1 | 2/2011 | Zellers et al. | |
| 2011/0133598 | A1 | 6/2011 | Jenninger et al. | |
| 2011/0290686 | A1 | 12/2011 | Huang | |
| 2012/0017703 | A1 | 1/2012 | Ikebe et al. | |
| 2012/0105333 | A1 | 5/2012 | Maschmeyer et al. | |
| 2012/0121944 | A1 | 5/2012 | Yamamoto et al. | |
| 2012/0126663 | A1 | 5/2012 | Jenninger et al. | |
| 2012/0126959 | A1 | 5/2012 | Zarrabi et al. | |
| 2012/0128960 | A1 | 5/2012 | Busgen et al. | |
| 2012/0178880 | A1 | 7/2012 | Zhang et al. | |
| 2012/0194448 | A1 | 8/2012 | Rothkopf | |
| 2012/0206248 | A1 | 8/2012 | Biggs | |
| 2012/0223880 | A1 | 9/2012 | Birnbaum et al. | |
| 2013/0207793 | A1 | 8/2013 | Weaber et al. | |
| 2014/0035735 | A1 | 2/2014 | Zellers et al. | |
| 2014/0085065 | A1 | 3/2014 | Biggs et al. | |
| 2014/0090424 | A1 | 4/2014 | Charbonneau et al. | |
| 2014/0139328 | A1 | 5/2014 | Zellers et al. | |
| 2014/0139329 | A1 | 5/2014 | Ramstein et al. | |
| 2014/0139436 | A1 | 5/2014 | Ramstein et al. | |
| 2014/0140551 | A1 | 5/2014 | Ramstein | |
| 2014/0191973 | A1 | 7/2014 | Zellers et al. | |

FOREIGN PATENT DOCUMENTS

| | | | |
|---|---|---|---|
| JP | 2012134998 | A | 7/2012 |
| KR | 20060107259 | A | 10/2006 |
| KR | 20110110212 | A | 10/2011 |
| KR | 20120013273 | A | 2/2012 |
| KR | 20120063318 | A | 6/2012 |
| KR | 20120078529 | A | 7/2012 |
| KR | 20120105785 | A | 9/2012 |
| WO | 2010/085575 | A1 | 7/2010 |

OTHER PUBLICATIONS

Neese, Bret et al., "Large Electrocaloric Effect in Ferroelectric Polymers Near Room Temperature", Science vol. 321, Aug. 8, 2008, pp. 821-823.

Zhang Q. M. et al., "Giant Electrostriction and Relaxor Ferroelectric Behavior in Electron-Irradiated Poly(vinylidene fluoride-trifluoroethylene) Copolymer", Science vol. 280, Jun. 26, 1998, pp. 2101-2104.

Xia F. et al., "High Electromechanical Responses in a Poly(vinylidene fluoride-trifluoroethylene-chlorofluoroethylene) Terpolymer", Advanced Materials, vol. 14, issue 21, Nov. 2002, pp. 1574-1577.

PCT International Search Report and Written Opinion date of mailing Dec. 23, 2013, International Patent Application No. PCT/US2013/053594, 9 pages.

PCT International Search Report and Written Opinion date of mailing Mar. 17, 2014, International Patent Application No. PCT/US2013/071085, 10 pages.

PCT International Search Report and Written Opinion date of mailing Mar. 13, 2014, International Patent Application No. PCT/US2013/071072, 15 pages.

PCT International Search Report and Written Opinion date of mailing Mar. 20, 2014, International Patent Application No. PCT/US2013/071075, 12 pages.

PCT International Search Report and Written Opinion date of mailing Mar. 28, 2014, International Patent Application No. PCT/US2013/071078, 13 pages.

PCT International Search Report and Written Opinion date of mailing Apr. 28, 2014, International Patent Application No. PCT/US2013/071062, 11 pages.

PCT International Preliminary Report on Patentability dated May 26, 2015, International Patent Application No. PCT/US2013/071072, 9 pages.

PCT International Preliminary Report on Patentability dated May 26, 2015, International Patent Application No. PCT/US2013/071075, 9 pages.

PCT International Preliminary Report on Patentability dated May 26, 2015, International Patent Application No. PCT/US2013/071078, 10 pages.

PCT International Preliminary Report on Patentability dated May 26, 2015, International Patent Application No. PCT/US2013/071085, 7 pages.

PCT International Preliminary Report on Patentability dated Jul. 7, 2015, International Patent Application No. PCT/IB2013/003212, 15 pages.

PCT International Written Opinion date of mailing Oct. 15, 2014, International Patent Application No. PCT/IB2013/003212, 20 pages.

* cited by examiner

RETRACTABLE SNAP DOMES

CROSS REFERENCE TO RELATED APPLICATION

The present application is related to and claims priority of U.S. provisional patent application Ser. No. 61/894,324, filed on Oct. 22, 2013, which is hereby incorporated by reference in its entirety for all purposes as if fully set forth herein.

BACKGROUND OF THE INVENTION

1. Field of the Invention

The present invention is related to electromechanical polymer (EMP) actuators. In particular, the present invention is related to applications of EMP actuators to keyboards or keypads of electronic devices, such as desktop and notebook computers.

2. Discussion of the Related Art

In some conventional keyboards, each key is seated on a snap dome that acts as a force resistor. The snap dome returns the key to the upright position after a depression by a user. However, conventional snap domes are incapable of lying flat in a stable state. The need to be ready for keyboard operation requires the snap domes to always return to their upright positions.

SUMMARY

According to one embodiment of the present invention, a retractable snap dome in a keyboard, in addition to serving as a force resistor for a key in a conventional manner, includes an additional collapsed state in which the key can be retracted by an electromechanical polymer (EMP) actuator to a persistent down position. In one embodiment, the EMP actuator is a bimorph EMP actuator that can be actuated to bring the key from the down position to the up position, ready for conventional keyboard operation, and vice versa. Such operations allow the keyboard to have a desirable decreased thickness relative to conventional keyboards. Thus, a keyboard of the present invention finds application in ultra-slim electronic devices. When provided in a notebook computer in which the keyboard is folded against a video or graphic display, the keys of the keyboard may be placed in the retracted down position, thereby preventing the keys from pressing against the video or graphical display with a force that may damage the display.

The present invention is better understood upon consideration of the detailed description below in conjunction with the drawings.

BRIEF DESCRIPTION OF THE DRAWINGS

FIG. 1(*b*) shows a first perspective view of retractable snap dome 100, from a first direction that is roughly 45 degrees out of the page from the side view of FIG. 1(*a*).

FIG. 1(*c*) shows a second perspective view of retractable snap dome 100, from a second direction that is roughly 45 degrees into the page from the side view of FIG. 1(*a*).

FIG. 2(*b*) illustrates the same three stages of retractable snap dome 100 of FIG. 2(*a*) in the conventional operation, as seen from the first direction.

FIG. 2(*c*) illustrates the same three stages of retractable snap dome 100 of FIG. 2(*a*) in the conventional operation, as seen from the second direction.

FIG. 4(*b*) illustrates the same three stages of retractable snap dome 100 of FIG. 4(*a*) under the powered, the activated and powered and the activated and unpowered states, as seen from the first direction.

FIG. 4(*c*) illustrates the same three stages of retractable snap dome 100 of FIG. 4(*a*) under the powered, the activated and powered and the activated and unpowered states, as seen from the second direction.

FIG. 5(*b*) illustrates the same three stages of retractable snap dome 100 of FIG. 5(*a*) under the powered, the activated and powered and the activated and unpowered states, as seen from the first direction.

FIG. 5(*c*) illustrates the same three stages of retractable snap dome 100 of FIG. 5(*a*) under the powered, the activated and powered and the activated and unpowered states, as seen from the second direction.

In the figures and the detailed description below, like reference numerals denote like features.

DETAILED DESCRIPTION OF THE PREFERRED EMBODIMENTS

Figure 1A:
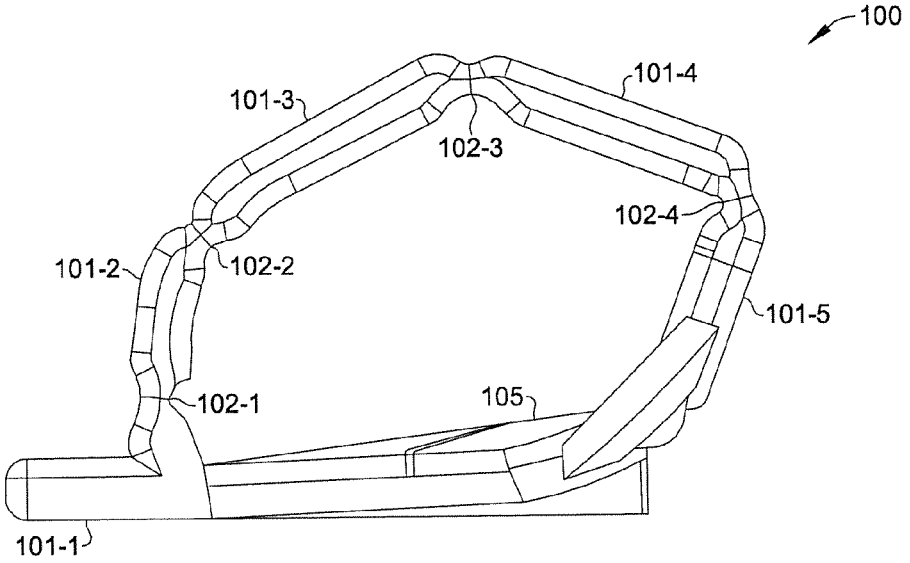
FIG. 1(*a*) shows a side view of retractable snap dome 100, according one embodiment of the present invention.
Figure 1B:
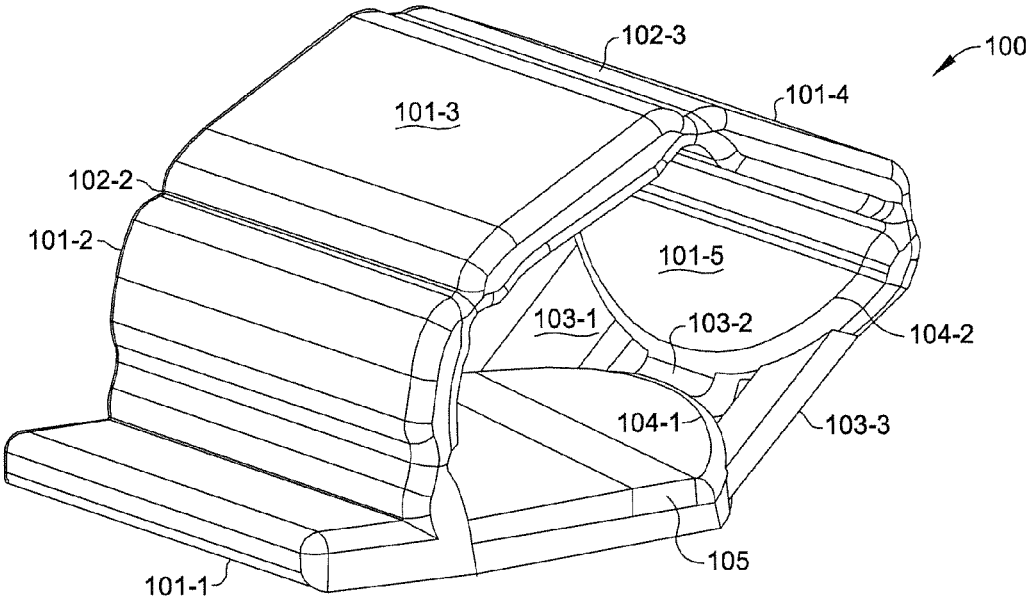
Figure 1C:
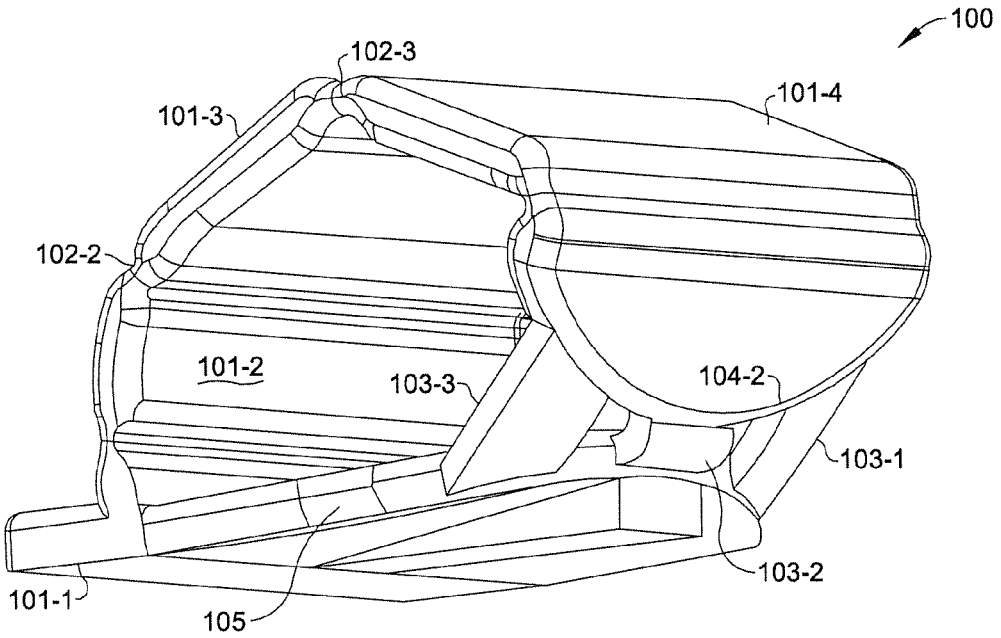

FIG. 1(*a*) shows a side view of retractable snap dome 100, according one embodiment of the present invention. FIG. 1(*b*) shows a first perspective view of retractable snap dome 100, from a first direction that is roughly 45 degrees out of the page from the side view of FIG. 1(*a*). FIG. 1(*c*) shows a second perspective view of retractable snap dome 100, from a second direction that is roughly 45 degrees into the page from the side view of FIG. 1(*a*). As shown in each of FIGS. 1(*a*), 1(*b*) and 1(*c*), retractable snap dome 100 include sections 101-1, 101-2, 101-3, 101-4 and 101-5, which are joined by folding ridges 102-1, 102-2, 102-3, and 102-4. These folding ridges are hinge points that facilitate and define the upright and collapsed positions of retractable snap dome 100. The upright position of retractable snap dome 100 is maintained by both the elasticity of segments 101-1 to 101-5 and shape-retention characteristics of folding ridges 102-1 to 102-4.

Sections 101-1 and 101-5 are also joined by hinge bars 103-1, 103-2 and 103-3 which form a bi-stable hinge between sections 101-1 and 101-5 of retractable snap dome 100. The bi-stable hinge has a first bi-stable state and a second bi-stable state, as described in further details below. As shown in FIG. 1(*b*), the bi-stable hinge connects between sections 101-1 and 101-5 at curved boundaries 104-1 and 104-2. Alternatively, section 101-1 and 101-5 may also be joined by an elastic ribbon to provide the same bi-stable states, as described in further details below. Embedded in section 101-5 is EMP actuator 105 adjacent to curve boundary 104-2 of section 101-4. In one embodiment, EMP actuator 105 may be provided by a bimorph EMP actuator which can be selectively actuated to provide a mechanical response (e.g., bending) in either one of two directions. A bimorph EMP actuator has two active regions, such that electrical stimulation in the first active region provides bending in one direction, and electrical stimulation in the second region provides bending in a second or opposite direction.

An electromechanical polymer (EMP) actuator typically includes one or more EMP layers formed out of a relaxor ferroelectric fluoropolymer and electrodes bonded thereto. When an external electric field is imposed across an EMP layer, the EMP layer becomes charged. The EMP layer thus behaves electrically as a capacitor. The electric field also provides an electromechanical response in the form of elongation in the transverse directions relative to the imposed electric field. The electromechanical property of the EMP layer is used to create the EMP actuator. EMP actuators are described, for example, in copending U.S. patent application ("Copending Application"), Ser. No. 13/683,963, entitled "Localized Multimodal Electromechanical Polymer Tranducers," filed on Nov. 21, 2012, naming B. Zellers et al. as inventors. The Copending Application is hereby incorporated by reference herein.

Figure 3:
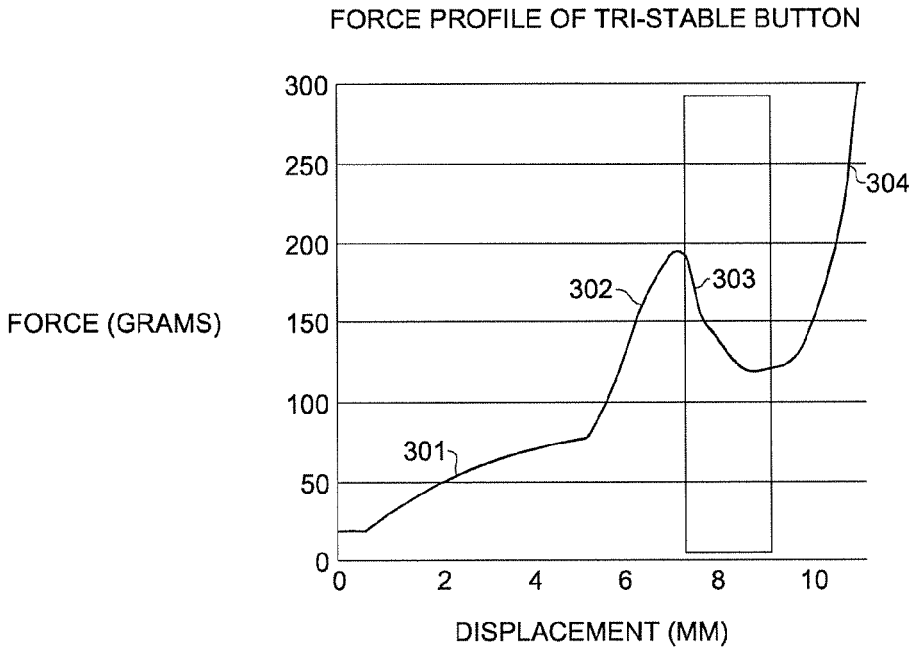
FIG. 3 shows a force profile of retractable snap dome 100 during the conventional operation.
Figure 2A:
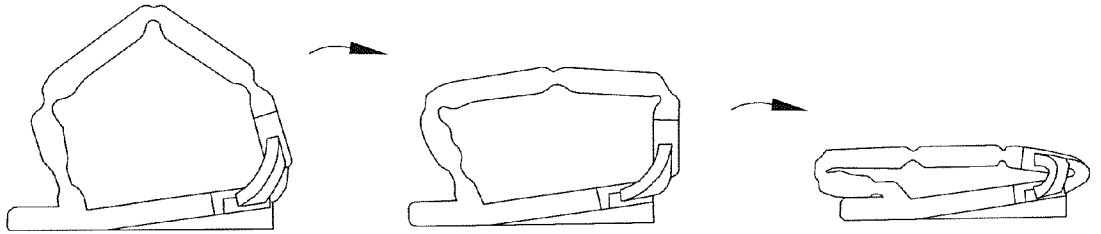
FIG. 2(*a*) illustrates three stages of retractable snap dome 100 in a conventional operation.
Figure 2B:
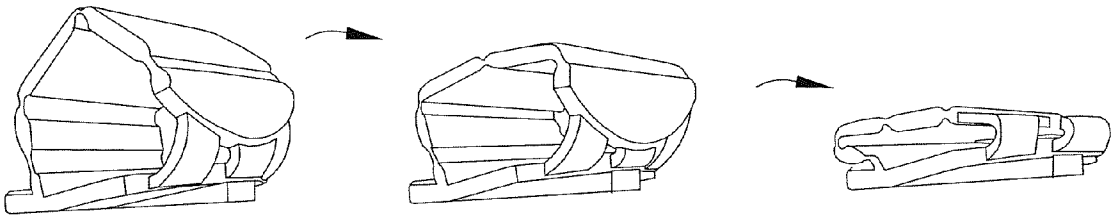
Figure 2C:
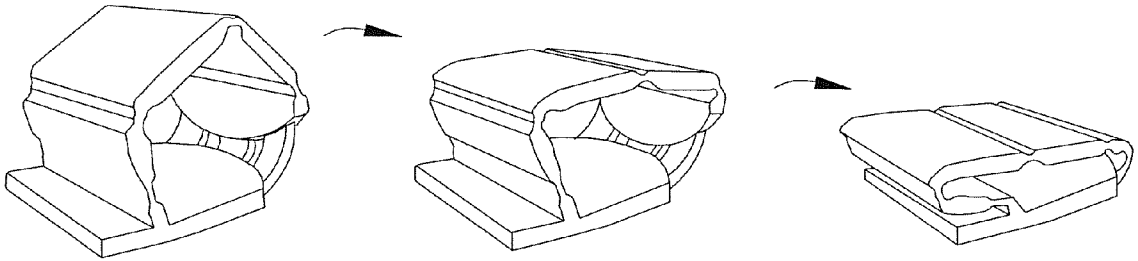

FIGS. 2(*a*), 2(*b*) and 2(*c*) each illustrate three stages of retractable snap dome 100 in a conventional (i.e., key depression) operation. FIG. 3 shows a force profile of retractable snap dome 100 during the conventional operation. FIG. 2(*a*) shows, in the left portion, a first stage in which retractable snap dome 100 is in its up position supporting a key (not shown) ready to receive the downward force of a key depression. Retractable snap dome 100 is designed to collapse and rise with little force. A downward force on segments 101-3 and 101-4 pushes segments 101-2 and 101-5 in opposite outward directions. The downward force is represented in FIG. 3 by curve segment 301.

In the middle portion, FIG. 2(*a*) shows a second stage in which sections 101-3 and 101-4 of retractable dome 100 are depressed to horizontal positions. In this stage, sections 101-2 and 101-3 are designed to be angled to the left of vertical and to be substantially vertical, respectively, so as to predispose retractable dome 100 to collapse to the left. Initially, the depression increases the load on section 101-2, with corresponding increased resistance, as represented by curve segment 302 of FIG. 3. Upon further depression, retractable snap dome 100 buckles to the left. The buckling action is represented by curve segment 303 of FIG. 3. The buckling brings retractable snap dome 100 to its collapsed position. The force profile in this configuration is represented by curve segment 304 in FIG. 3.

In the right portion, FIG. 2(*a*) shows a collapsed position of retractable snap dome 100 upon further depression.

FIG. 2(*b*) illustrates the same three stages of retractable snap dome 100 of FIG. 2(*a*) in the conventional operation, as seen from the first direction. FIG. 2(*c*) illustrates the same three stages of retractable snap dome 100 of FIG. 2(*a*) in the conventional operation, as seen from the second direction.

Figure 4A:
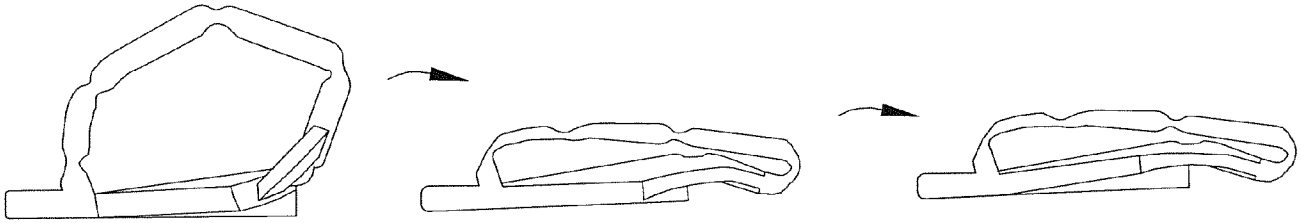
FIG. 4(*a*) illustrates three stages of retractable snap dome 100—from upright to collapsed—under powered, activated and powered and activated and unpowered states, in accordance with one embodiment of the present invention.
Figure 4B:
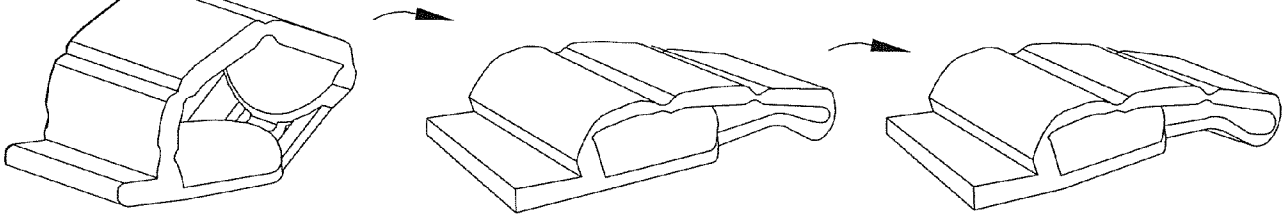
Figure 4C:
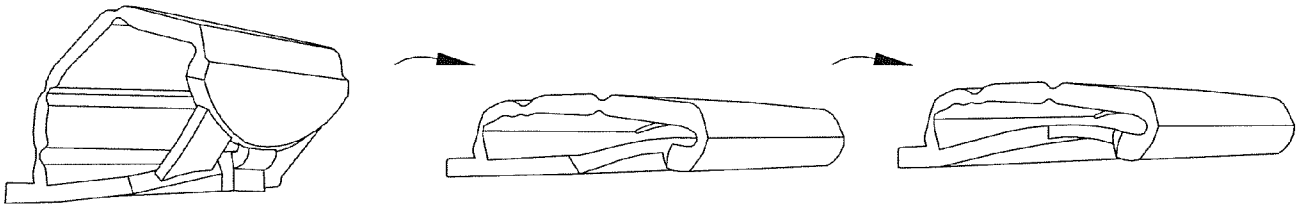

According to one embodiment of the present invention, EMP actuator 105 may be actuated to bring retractable snap dome 100 to a collapsed position that may persist indefinitely, even after electrical stimulation is withdrawn. FIG. 4(*a*) illustrates three stages of retractable snap dome 100—from upright to collapsed—under powered, activated and powered and activated and unpowered states of EMP actuator 105, in accordance with one embodiment of the present invention. In the left portion, FIG. 4(*a*) shows retractable snap dome 100 when activation of EMP actuator 105 is initiated by application of a voltage across one or more EMP layers in EMP actuator 105. Initially, retractable snap dome 100 is in its upright position, bi-stable hinge is in a first bi-stable state, and EMP actuator 105 is unpowered. As shown in the left portion of FIG. 4(*a*), activation causes EMP actuator 105 to provide an electromechanical response (e.g., bending) that acts on curved boundary 104-1 and pushes section 101-5 towards the right, and eventually causes the bi-stable hinge to the second bi-stable state.

As mentioned above, hinge bars 103-1, 103-2 and 103-3 form the bi-stable hinge. (The bi-stable hinge can also be formed by an elastic ribbon, as also mentioned above). The two bi-stable states are lower energy configurations than the unstable intermediate state in which curved boundaries 104-1 and 104-2 have the greatest distance from each other at hinge bars 103-1 and 103-3. This configuration compresses hinge bar 103-2 and puts hinge bars 101-1 and 101-3 in greatest tension. The unstable state may resolve into either one of the bi-stable states, in which hinge bars 103-1 and 103-3 are relatively unstrained. As further electrical stimulation is applied to EMP actuator 105, retractable snap dome 100 flattens to the right, the tension in each of hinge bars 101-1 and 101-3 increases towards the unstable state. When the bi-stable hinge reaches the unstable state, further bending of EMP actuator 105 pushes the bi-stable hinge to rapidly snap into the second bi-stable state. At this point, retractable snap dome 100 has buckled and collapsed to the right, as shown in the middle portion of FIG. 4(*a*).

As mentioned above, EMP actuator 105 remains charged even when power is withdrawn. Even when disconnected from power, EMP actuator 105 maintains its mechanical state at the time of power disconnection. Therefore, if power is disconnected after the bi-stable hinge settles in the second bi-stable state, EMP actuator 105 locks retractable snap dome 100 in the collapsed state, as shown in the right portion of FIG. 4(*a*).

FIG. 4(*b*) illustrates the same three stages of retractable snap dome 100 of FIG. 4(*a*) under the powered, the activated and powered and the activated and unpowered states of EMP actuator 105, as seen from the first direction. FIG. 4(*b*) illustrates the same three stages of retractable snap dome 100 of FIG. 4(*a*) under the powered, the activated and powered and the activated and unpowered states of EMP actuator 105, as seen from the second direction.

Figure 5A:
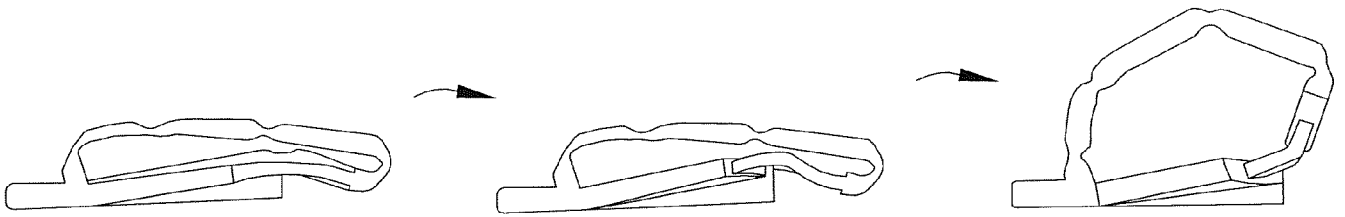
FIG. 5(*a*) illustrates three stages of retractable snap dome 100—from collapsed to upright—under powered, activated and powered and activated and unpowered states of EMP actuator 105, in accordance with one embodiment of the present invention.
Figure 5B:
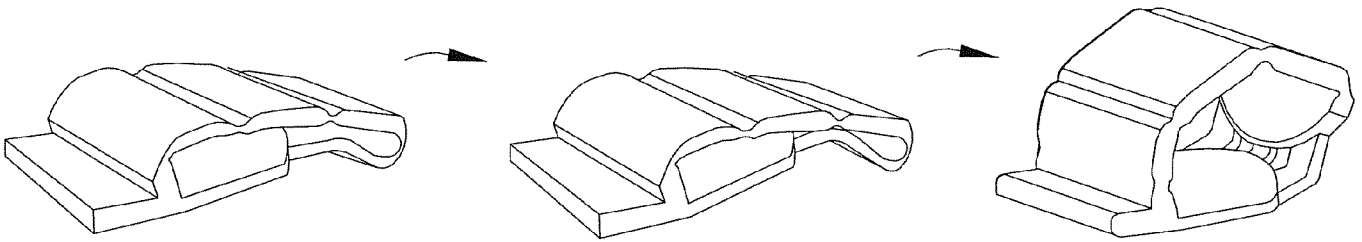
Figure 5C:
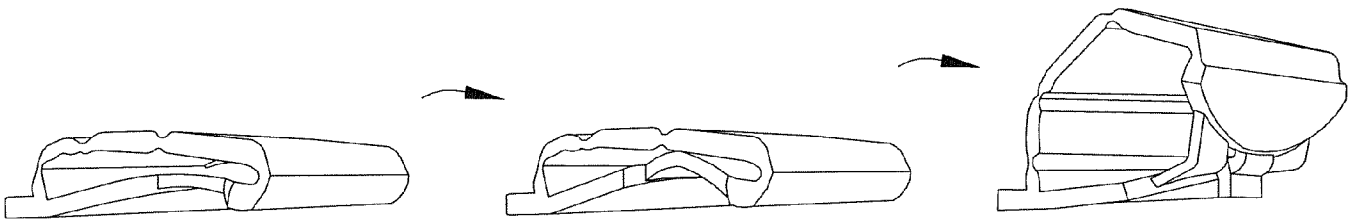

To return retractable snap dome 100 to the upright position, EMP actuator 105 may be provided the electrical stimulation in reverse from that illustrated by FIGS. 4(*a*), 4(*b*) and 4(*c*). FIG. 5(*a*) illustrates three stages of retractable snap dome 100—from collapsed to upright—under powered, activated and powered and activated and unpowered states of EMP actuator 105, in accordance with one embodiment of the present invention. In the left portion of FIG. 5(*a*), retractable snap dome 100 is shown initially in the locked-down collapsed state shown in the right portion of FIG. 4(*a*). In the embodiment in which EMP actuator 105 is implemented by a bimorph EMP actuator, EMP actuator 105 is activated to bend in the opposite direction to drive the bi-stable hinge from the second bi-stable state to the first bi-stable state, which is shown in the middle portion of FIG. 5(*a*). After retractable snap dome 100 is returned to the upright position, as shown in the right portion of FIG. 5(*a*), electrical stimulation of EMP actuator 105 may be withdrawn. Retractable snap dome 100 is thus locked-down to the upright position to be ready to perform conventional operation.

FIG. 5(*b*) illustrates the same three stages of retractable snap dome 100 of FIG. 5(*a*) under the powered, the activated and powered and the activated and unpowered states, as seen from the first direction. FIG. 5(*b*) illustrates the same three stages of retractable snap dome 100 of FIG. 5(*a*) under the powered, the activated and powered and the activated and unpowered states, as seen from the second direction.

In one embodiment, EMP actuator 105 produces a force in the ~10 g range to facilitate retractable snap dome 100 to rise to the upright state or to fall to the collapsed state through the action of the bi-stable hinge. (Movement in the bi-stable hinge is realized by a weak pull/push horizontal force). In comparison, from the locked-down upright position of retractable snap dome 100, a downward force in the range of ~50-200 g is required to collapse retractable snap dome 100 in conventional operation.

A retractable snap dome of the present invention consumes power only for collapsing the structure for storage or returning the structure back to its upright position. In a keyboard application, for example, the EMP actuator is not involved in the conventional typing operation, and thus the advantages are achieved with little power consumption.

The above detailed description is provided to illustrate specific embodiments of the present invention and is not intended to be limiting. Numerous variations and variations within the scope of the present invention is possible. The present invention is set forth in the accompanying claims.

The invention claimed is:

1. A structure having a first configuration and a second configuration, comprising:

a plurality of structural elements;

a plurality of connecting elements connecting the structural elements, including a poly-stable connecting element having a first stable state, a second stable state and an unstable intermediate state extending between the first stable state and the second stable state wherein, when the poly-stable connecting element in the first stable state, the structure is in the first configuration and wherein, when the poly-stable element is in the second stable state, the structure is in the second configuration; and an electromechanical (EMP) actuator located in a non-articulating base element, separate from the plurality of structural and connecting elements, and operationally coupled to the poly-stable connecting element, such that a mechanical response to an electrical stimulation of the EMP actuator switches the poly-stable connecting element from the first stable state through the unstable intermediate state to the second stable state.

2. The structure of claim 1, wherein the structure comprises a retractable snap dome.

3. The structure of claim 2 wherein, in the first configuration, the retractable snap dome is in an upright position and wherein, in the second configuration, the retractable snap dome is collapsed.

4. The structure of claim 1, wherein the poly-stable connecting element comprises a bi-stable hinge.

5. The structure of claim 1, wherein the poly-stable connecting element comprises a bi-stable ribbon connector.

6. The structure of claim 1, wherein the EMP actuator comprises a bimorph EMP actuator.

* * * * *